US008516718B2

(12) United States Patent
Lonsway et al.

(10) Patent No.: US 8,516,718 B2
(45) Date of Patent: Aug. 27, 2013

(54) ARTICLE OF FOOTWEAR WITH THONG PORTION INCLUDING GROOVES

(71) Applicant: Nike, Inc., Beaverton, OR (US)

(72) Inventors: Eric Lonsway, Portland, OR (US); Kelly A. O'Connor, Beaverton, OR (US); Thomas W. Simshaw, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 13/682,029

(22) Filed: Nov. 20, 2012

(65) Prior Publication Data

US 2013/0185954 A1 Jul. 25, 2013

Related U.S. Application Data

(62) Division of application No. 12/502,090, filed on Jul. 13, 2009, now Pat. No. 8,336,228.

(51) Int. Cl.
*A43B 3/12* (2006.01)

(52) U.S. Cl.
USPC ..... 36/11.5; 36/94

(58) Field of Classification Search
USPC ..... 36/11.5, 94; D2/916
See application file for complete search history.

(56) References Cited

U.S. PATENT DOCUMENTS

| | | | | | |
|---|---|---|---|---|---|
| 1,875,162 | A * | 8/1932 | Sayers | 36/11.5 |
| 2,928,191 | A | 3/1960 | Meltzer | |
| 4,017,987 | A * | 4/1977 | Perez et al. | 36/11.5 |
| D271,156 | S * | 11/1983 | Williamson | D2/916 |
| 4,584,782 | A | 4/1986 | Thatcher | |
| 5,946,823 | A * | 9/1999 | Yates | 36/11.5 |
| D481,828 | S * | 11/2003 | Goldberg et al. | D28/56 |
| 6,678,971 | B2 * | 1/2004 | Brooks | 36/94 |
| D568,590 | S * | 5/2008 | Brea | D2/916 |
| D591,487 | S * | 5/2009 | Hayek | D2/916 |
| 7,681,332 | B2 * | 3/2010 | Allen | 36/94 |
| 7,980,005 | B1 * | 7/2011 | Young | 36/11.5 |
| 8,336,228 | B2 * | 12/2012 | Lonsway et al. | 36/11.5 |
| 2004/0168346 | A1 * | 9/2004 | Boncutter et al. | 36/8.1 |
| 2008/0086825 | A1 | 4/2008 | Mullen | |
| 2010/0024247 | A1 | 2/2010 | Feeney et al. | |
| 2011/0005102 | A1 | 1/2011 | Lonsway et al. | |

FOREIGN PATENT DOCUMENTS

| | | |
|---|---|---|
| AR | 077409 | 8/2011 |
| BR | 9601291 | * 11/1996 |
| BR | 9601292 | 11/1996 |

(Continued)

OTHER PUBLICATIONS

International Search Report and Written Opinion, mailed Nov. 23, 2010 in International Application No. PCT/US2010/041655.

International Preliminary Report on Patentability (including Written Opinion of the ISA) mailed Jan. 26, 2012 in International Application No. PCT/US2010/041655.

(Continued)

*Primary Examiner* — Ted Kavanaugh
(74) *Attorney, Agent, or Firm* — Plumsea Law Group, LLC

(57) ABSTRACT

An article of footwear with a thong portion is disclosed. The thong portion is configured to fit between two adjacent toes to help fasten a pair of straps to a foot. The thong portion includes a plurality of grooves that enhance the grip between the thong portion and a portion of the foot between the two adjacent toes. The plurality of grooves can also enhance the flexibility of the thong portion to help the thong portion conform to the contours of the foot.

20 Claims, 10 Drawing Sheets

(56) References Cited

FOREIGN PATENT DOCUMENTS

| | | | |
|---|---|---|---|
| CN | 102497791 | A | 6/2012 |
| JP | 2009-512529 | | 3/2009 |
| JP | 2012532736 | | 12/2012 |
| WO | 2007049024 | | 5/2007 |
| WO | WO2007/049024 | * | 5/2007 |
| WO | 2011008667 | | 1/2011 |

OTHER PUBLICATIONS

Response to Communication pursuant to Rule 161 (1) EPC filed Jul. 26, 2012 in European Patent Application No. EP 10 732 821.3.
Voluntary Amendment filed Sep. 18, 2012 in Chinese Patent Application No. 201080040552.5, and English translation thereof.
Office Action dated May 29, 2013 in Korean Patent Application No. 10-2012-7003686 and English Translation thereof.

* cited by examiner

ARTICLE OF FOOTWEAR WITH THONG PORTION INCLUDING GROOVES

CROSS-REFERENCE TO RELATED APPLICATION

This application is a divisional of Lonsway et al., U.S. Patent Application Publication No. 2011/0005102, published on Jan. 13, 2011, the entire disclosure of which is incorporated herein by reference.

BACKGROUND

The present invention relates generally to an article of footwear, and in particular to an article of footwear with a thong portion including grooves.

Meltzer (U.S. Pat. No. 2,928,191) teaches an article of footwear that includes a toe thong that is composed of a tube of woven fabric that is enveloped around a coil spring which extends coaxially through the tube. The spring is attached at its upper hooked end to an attachment loop that is located on the underside of an ornamental button. The upper end of the tube is pushed up to the concealed hooked end. The tube and the spring pass through an opening in the inner sole where an anchoring means penetrates the tube and engages a loop at the lower end of the spring in the outer sole. The tube is adhesively secured to the button and the outer sole. In another embodiment, the thong is connected to and extends through a portion of an upper. Meltzer teaches that the woven fabric of the tube is elastic so that the tube is stretchable in a longitudinal direction for a limited extent to assure a proper fit for different foot and toe sizes.

The related art requires a toe thong including multiple pieces, which can increase manufacturing costs and reduce manufacturing efficiency. There is a need for articles that address the limitations of the related art.

SUMMARY

In one aspect, the invention provides an article of footwear, comprising: a sole; a thong portion configured to be received between two toes of a foot; the thong portion including a first end portion, a second end portion and an intermediate portion disposed between the first end portion and the second end portion; the first end portion associated with a portion of the sole; the second end portion associated with a strap, the strap wrapping around a portion of the foot; and where the intermediate portion includes a groove.

In another aspect, the invention provides an article of footwear, comprising: a sole; a thong portion including a first end portion, a second end portion and an intermediate portion disposed between the first end portion and the second end portion; the first end portion associated with a first portion of the sole; the second end portion associated with a strap, the strap wrapping around a portion of a foot; the thong portion comprising a substantially monolithic portion including a first portion and a second portion; and where the first portion is configured to provide more grip with a portion of the foot than the second portion.

In another aspect, the invention provides an article of footwear, comprising: a sole; a thong portion including a first end portion, a second end portion and an intermediate portion disposed between the first end portion and the second end portion; the first end portion associated with a first portion of the sole; the second end portion associated with a strap, the strap wrapping around a portion of a foot; the intermediate portion comprising a first groove and a second groove; and where a first depth of the first groove is different from a second depth of the second groove.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
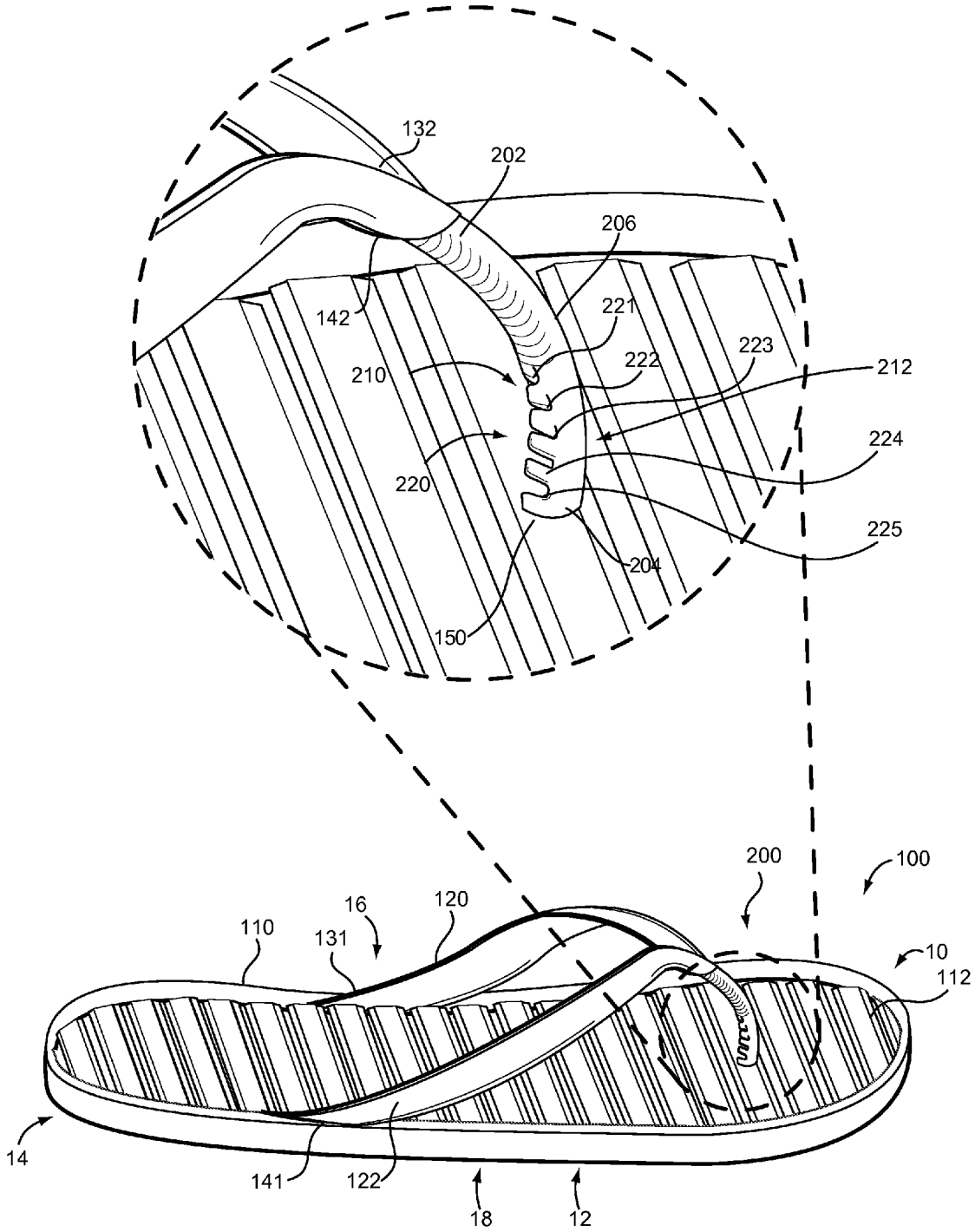
FIG. 1 is an isometric view of an embodiment of an article of footwear.

FIG. 1 illustrates a view of an exemplary embodiment of article of footwear 100. For clarity, the following detailed description discusses an exemplary embodiment, in the form of a sandal or flip-flop, but it should be noted that the present invention could take the form of any article of footwear including, but not limited to: hiking boots, soccer shoes, football shoes, sneakers, rugby shoes, basketball shoes, baseball shoes as well as other kinds of shoes. As shown in FIG. 1, article of footwear 100, also referred to simply as article 100, is intended to be used with a left foot; however, it should be understood that the following discussion may equally apply to a mirror image of article of footwear 100 that is intended for use with a right foot.

Referring to FIG. 1, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of an article, rather than precisely demarcating article 100 into two halves. In addition, forefoot portion 10, midfoot portion 12 and heel portion 14, as well as lateral side 16 and medial side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. It will be understood that each of these directional adjectives may be applied to individual components of an article, such as an upper and/or a sole structure.

Article 100 can include sole structure 110. In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

Sole structure 110 extends between the foot and the ground when article 100 is worn. In different embodiments, sole structure 110 may include different components. For example, sole structure 110 may include an outsole, a midsole, and/or an insole. In some cases, one or more of these components may be optional. Although the exemplary embodiment does not include an upper, in other embodiments article 100 could include an upper.

Sole 110 can include upper portion 112 that is configured to receive a foot. In some cases, upper portion 112 can include provisions for increasing grip with a foot. In the exemplary embodiment, for example, upper portion 112 can comprise a ribbed surface that helps increase grip on a bottom surface of a foot. In other cases, other provisions for increasing grip with a foot can be used including, but not limited to: nubs, grooves, as well as any other provisions. Still further, in some cases, upper portion 112 can comprise a material with a high coefficient of friction.

In some embodiments, article 100 can include provisions for securing a foot to sole structure 110. In some cases, article 100 can include one or more straps that may wrap around a portion of a foot. In one embodiment, article 100 can include first strap 120 and second strap 122. First strap 120 may include first end portion 131 that is attached to lateral side 16 of sole structure 110. Second strap 122 may include first end portion 141 that is attached to medial side 18 of sole structure 110. Furthermore, in some cases, first end portion 131 of first strap 120 and first end portion 141 of second strap 122 may be attached to sole structure 110 at heel portion 14.

In some embodiments, first strap 120 and second strap 122 may comprise two distinct straps. In other embodiments, however, first strap 120 and second strap 122 may comprise different portions of a single strap. For example, in one embodiment, first end portion 131 of first strap 120 and first end portion 141 of second strap 122 may be attached through sole structure 110.

In addition, while two straps are illustrated in the current embodiment, other embodiments could include additional straps or provisions for securing sole structure 110 to a foot. In another embodiment, for example, article 100 could include a heel strap that extends across a heel of a foot. In still other embodiments, additional straps could be provided in forefoot portion 10 and/or midfoot portion 12 for securing a foot to sole structure 110.

Article 100 can include provisions for attaching first strap 120 and second strap 122 to forefoot portion 10 of sole structure 110. In some embodiments, article 100 can include a thong portion that is configured to extend between forefoot portion 10 of sole structure 110 and portions of first strap 120 and second strap 122. In other embodiments, first strap 120 and second strap 122 may be directly attached to forefoot portion 10.

In the exemplary embodiment, article 100 may include thong portion 200. Thong portion 200 can include first end portion 202 and second end portion 204. In addition, thong portion 200 can include intermediate portion 206 that is disposed between first end portion 202 and second end portion 204. In some cases, first end portion 202 may be configured to attach to second end portion 132 of first strap 120 as well as second end portion 142 of second strap 122. Second end portion 204 of thong portion 200 may be attached to sole structure 110. With this arrangement, thong portion 200 can help to connect first strap 120 and second strap 122 with sole structure 110.

Thong portion 200 can be attached to sole structure 110 in any manner. In some cases, second end portion 204 may be inserted through aperture 150 in upper portion 112. Also, second end portion 204 can be associated with an anchor portion or engaging portion that is larger than aperture 150 and so prevents second end portion 204 from pulling out of aperture 150. In other cases, second end portion 204 can be fastened to sole structure 110 in any other manner, including, but not limited to: gluing, stitching, as well as any other method of fastening. In still other cases, second end portion 204 can be integrally formed with a portion of sole structure 110.

Thong portion 200 can be attached to first strap 120 and/or second strap 122 in any manner. In some cases, first end portion 202 may be attached to second end portion 132 of first strap 120 and/or second end portion 142 of second strap 122 using an adhesive. In other cases, first end portion 202 may be integrally formed with a portion of first strap 120 and/or second strap 122. In still other cases, first end portion 202 can be stitched to second end portion 132 and/or second end portion 142.

In some embodiments, thong portion 200 can be configured to insert between two adjacent toes of a foot. For example, in one embodiment, thong portion 200 may be attached to a portion of sole structure 110 so that thong portion 200 is inserted between the hallux (big toe) and the index toe of the foot. In another embodiment, thong portion 200 could be inserted between other adjacent toes of a foot. In other cases, thong portion 200 could be inserted between the index toe and the middle toe. In still other cases, thong portion 200 could be inserted between the middle toe and the fourth toe. In still other cases, thong portion 200 could be inserted between the fourth toe and the little toe. With this arrangement, thong portion 200 can facilitate securing sole structure 110 to a foot.

In order to enhance the fit of straps to a foot, a thong portion can include provisions for increasing grip with a portion of the foot. In some embodiments, a thong portion can be configured with increased grip for engaging a portion of a foot disposed between adjacent toes. For example, a thong portion can include a portion that is configured to engage with the skin or webbing that connects adjacent toes of the foot. In some cases, a thong portion can include a first portion and a second portion. The first portion may be configured to provide enhanced grip over the second portion. For example, the first portion may be a portion of the thong portion that is oriented towards a heel portion of the article in order to engage with a portion of the foot when the thong portion is inserted between adjacent toes. In contrast, the second portion may be a generally smooth portion of the thong portion that is disposed opposite of the first portion.

In one embodiment, thong portion 200 can include first portion 210 and second portion 212. In some cases, first portion 210 is a portion of thong portion 200 that is configured to engage with the region between two adjacent toes of a foot. In this case, first portion 210 may generally be oriented to face heel portion 14 of article 100. Also, in some cases, second portion 212 may be a generally smooth portion of thong portion 200 that is disposed opposite of first portion 210. In some cases, second portion 212 may be oriented in a direction towards the front of forefoot portion 10.

In some embodiments, first portion 210 may be a grip enhancing portion. In some cases, first portion 210 may comprise a material that helps enhance grip. For example, first portion 210 could comprise a rubber material with a substantially high coefficient of friction. In other cases, first portion 210 may be configured with structural features that help to enhance grip. In an exemplary embodiment, first portion 210 may be provided with a plurality of grooves for enhancing the grip of thong portion 200. The term "groove" as used throughout this detailed description and in the claims refers to any channel, slot, sipe, recess, indentation or other similar structural feature. The term groove is not intended to be limited to any particular geometry or dimensions. Additionally, the term groove is not limited to use with any particular type of material or combination of materials.

First portion 210 can include plurality of grooves 220. In some cases, plurality of grooves 220 can include at least one grove. In other cases, plurality of grooves 220 can include two or more grooves. In still other cases, plurality of grooves 220 can include five grooves. In still other cases, plurality of grooves 220 can include more than five grooves. In the exemplary embodiment, plurality of grooves 220 can include first groove 221, second groove 222, third groove 223, fourth groove 224 and fifth groove 225.

The material properties of thong portion 200, including first portion 210 and second portion 212, can vary. First portion 210, including plurality of grooves 220, can comprise a first material. Second portion 212 may comprise a second material. In some cases, the first material may be substantially different than the second material. In other cases, the first material may be substantially similar to the first material. In an exemplary embodiment, the first material and the second material may be substantially similar. In other words, thong portion 200 may comprise a substantially monolithic material. With this arrangement, the durability of thong portion 200 may be increased over designs comprising multiple distinct components or materials.

Figure 2:
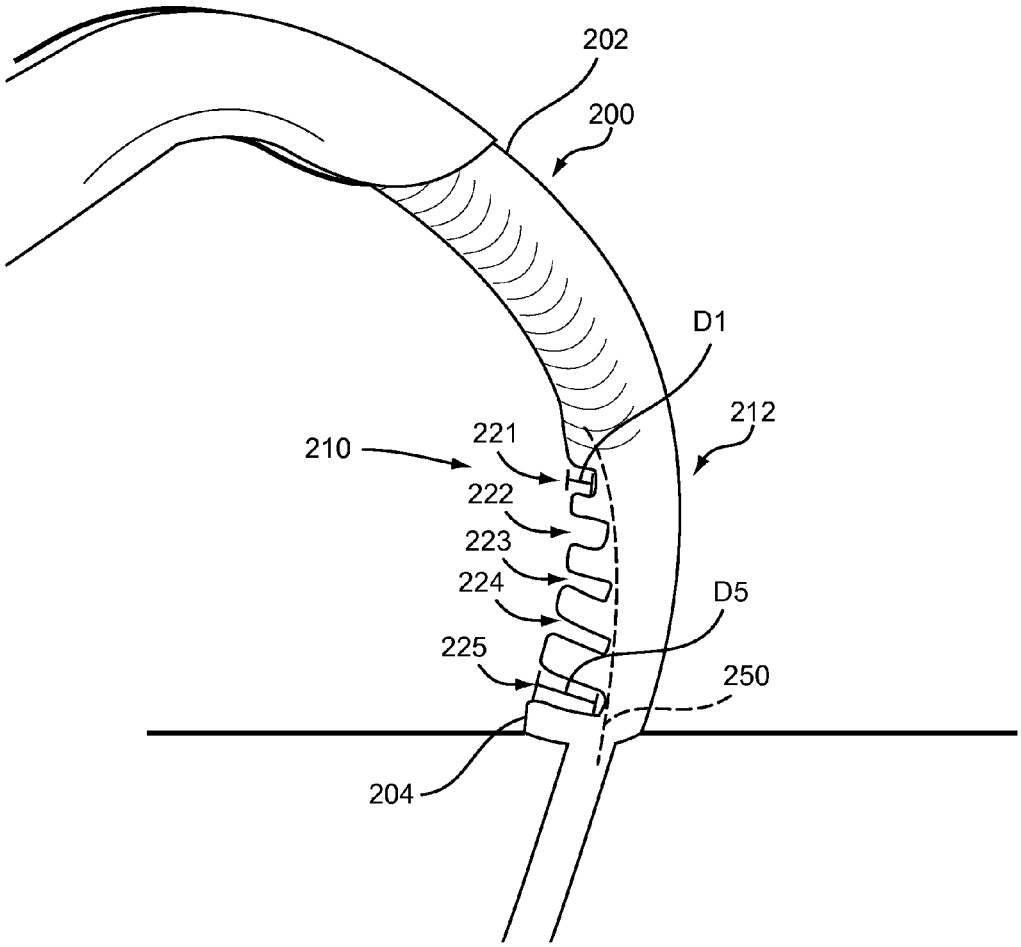
FIG. 2 is an enlarged view of an embodiment of a thong portion of an article of footwear.

FIG. 2 illustrates an enlarged view of thong portion 200 as seen in profile. Referring to FIG. 2, in different embodiments, the geometry of one or more grooves of plurality of grooves 220 can vary. For example, the cross sectional-shapes of one or more grooves can vary. Examples of different cross-sectional shapes that could be used include, but are not limited to: circular, semi-circular, elliptical, triangular, rectangular, polygonal, regular, irregular as well as any other kind of cross-sectional shapes. In an exemplary embodiment, each groove of plurality of grooves 220 may have an approximately semi-circular cross-sectional shape. In other embodiments, however, different grooves could be provided with different cross-sectional shapes. Furthermore, in other embodiments, other aspects of the groove geometry could be varied.

In different embodiments, the height, width and/or depth of one or more grooves can be varied. In some embodiments, the height of one or more grooves can vary. The term "height" refers to a dimension of the grooves extending along the length of thong portion 200. The term height as used here may also refer to the pitch of a groove. In some cases, the height of each groove of plurality of grooves can have a value in the range between 0.1 mm and 1 cm. In other cases, the height of each groove can have a value in the range between 1 mm and 10 mm. In addition, in some cases, each groove of plurality of grooves 220 can have substantially similar heights. In other cases, however, two or more grooves of plurality of grooves 220 can have substantially different heights.

In some embodiments, the width of one or more grooves can vary. The term "width" refers to a dimension of the grooves extending from a lateral side to a medial side of thong portion 200. In some cases, each groove of plurality of grooves 220 can have a variable width. In other cases, each groove of plurality of grooves 220 can have a substantially constant width. Furthermore, in some cases, each grove of plurality of groves 220 can have substantially similar widths to one another. In other cases, however, two or more grooves of plurality of grooves 220 can have substantially different widths.

In some embodiments, the depth of one or more grooves can vary. The term "depth" refers to a dimension of the groove that extends inwardly from an outer surface of thong portion 200. In some embodiments, each groove of plurality of grooves 220 can have substantially similar depths. In other embodiments, two or more grooves of plurality of grooves 220 can have substantially different depths. In the exemplary embodiment, first groove 221 may have a depth D1. In addition, fifth groove 225 may have a depth D5. In some cases, depth D5 may be substantially greater than depth D1. Also, the depths of second groove 222, third groove 223 and fourth groove 224 may increase monotonically between depth D1 and depth D5. In other words, second groove 222 may be substantially deeper than first groove 221, third groove 223 may be substantially deeper than second groove 222, fourth groove 224 may be substantially deeper than third groove 223 and fifth groove 225 may be substantially deeper than fourth groove 224. In one embodiment, depth D1 may have a value in the range between 0.1 mm and 5 mm. Also, depth D5 may have a value in the range between 1 mm and 20 mm. In other embodiments, however, depth D1 and depth D5 can have any other values.

Using this arrangement of grooves of varying depths, the gripping properties of thong portion 200 can be varied over the length of thong portion 200. In particular, the grip of thong portion 200 may be greatest at second end portion 204 since fifth groove 225 has the largest depth. Likewise, the gripping properties of thong portion 200 may decrease from second end portion 204 to first end portion 202, as the depth of plurality of grooves 220 decreases between second end portion 204 and first end portion 202.

In some embodiments, the depths of plurality of grooves 220 can vary in a nonlinear manner. For example, in an exemplary embodiment, the depths of plurality of grooves 220 can be associated with curve 250. In other words, the end portions of each groove of plurality of grooves 220 can be approximately aligned with curve 250. In other embodiments, however, the depths of plurality of grooves 220 can vary in a linear manner. In still other embodiments, the depths of plurality of grooves 220 can vary in any other manner. Alternative configurations for the depths of a plurality of grooves are discussed in detail below.

In some embodiments, providing a plurality of grooves can also help to vary the flexibility of a thong portion. This increased flexibility may result from the reduced cross-sectional profile of the thong portion in the grooved regions. Furthermore, in some cases, differential flexibility may be achieved along a thong portion by varying the geometry, including the depths, of one or more grooves. In the current embodiment, plurality of grooves 220 may provide enhanced flexibility for thong portion 200 at first portion 210. In addition, the varying depths of plurality of grooves 220 may provide differential flexibility over the length of thong portion 200. In particular, the flexibility of first portion 210 may increase from first groove 221 to fifth groove 225 on thong portion 200 since first groove 221 is shallower than fifth groove 225.

Figure 3:
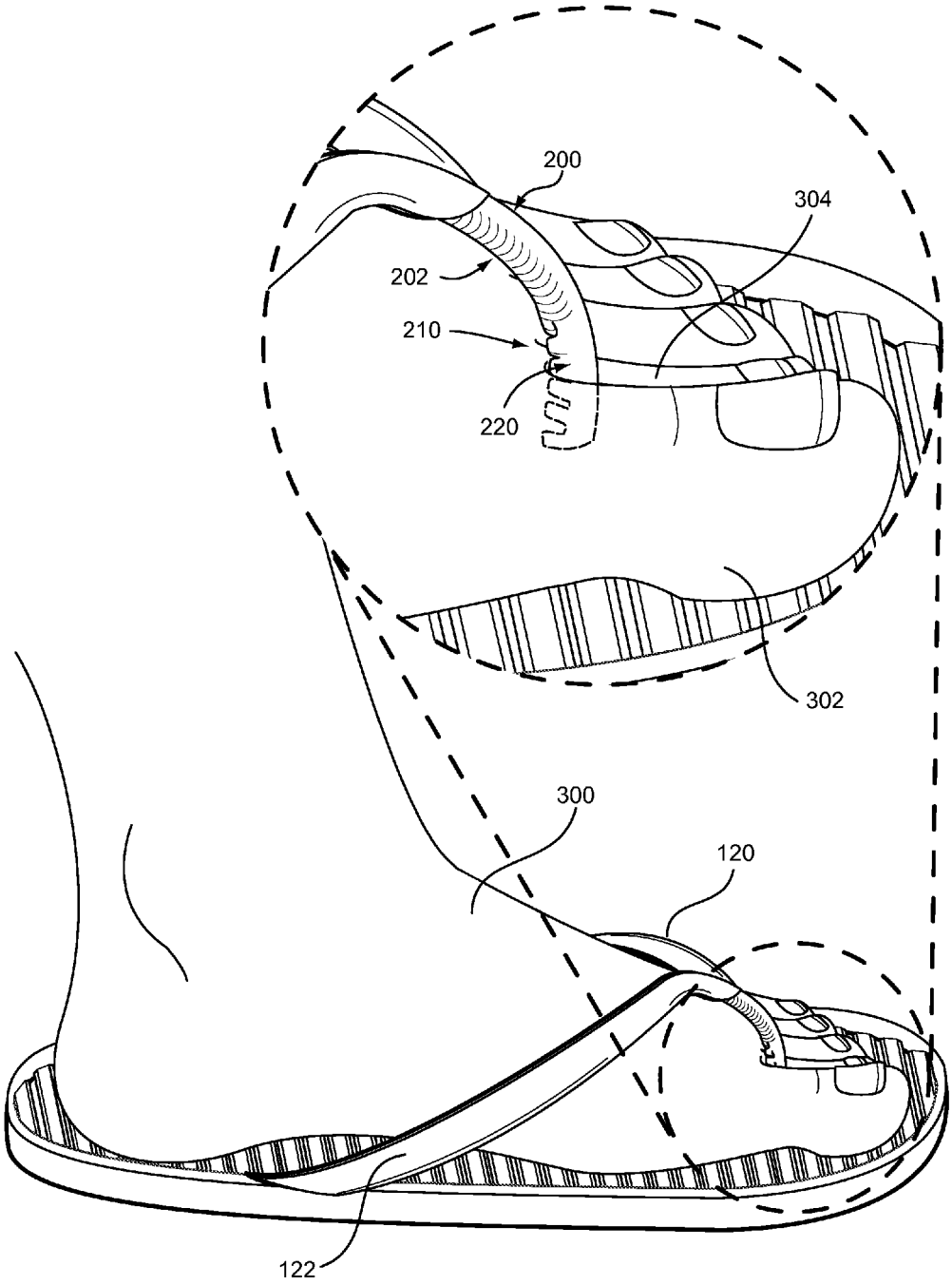
FIG. 3 is an isometric view of an embodiment of an article of footwear receiving a foot.

FIG. 3 illustrates an isometric view of an embodiment of thong portion 200 engaging with foot 300. First strap 120 and second strap 122 are secured around foot 300. In particular, first strap 120 and second strap 122 wrap around an upper portion of foot 300 as well as along lateral and medial sides of foot 300. In addition, thong portion 200 is inserted between big toe 302 and index toe 304. In particular, first portion 210, which includes plurality of grooves 220, may engage with skin or webbing disposed between big toe 302 and index toe 304. With this arrangement, thong portion 200 can be prevented from sliding in between big toe 302 and index toe 304 in order to help enhance the fit of article 100 on foot 300. In particular, thong portion 200 may be substantially fixed in place in a generally vertical direction, which can help to keep first strap 120 and second strap 122 secured in place on foot 300.

In addition to enhancing grip between thong portion 200 and foot 300, plurality of grooves 220 can also facilitate the bending of thong portion 200. In some cases, first portion 210 of thong portion 200 may be configured to conform to foot 300 in the vicinity of big toe 302 and index toe 304. This arrangement can help improve comfort and fit for article 100.

FIGS. 4 through 7 illustrate alternative embodiments of a thong portion including various arrangements for a plurality of grooves. For purposes of clarity, only the thong portions are shown in these alternative embodiments. However, it will be understood that the thong portions discussed here may be associated with articles similar to article 100 of the previous embodiment. Furthermore, the thong portions may generally extend between a forefoot portion of the corresponding article and one or more straps, in a similar manner to the arrangement described in the previous embodiment.

In different embodiments, a thong portion including a plurality of grooves can include provisions for fine tuning the gripping properties of the plurality of grooves to enhance the fit of an article. In some embodiments, the gripping properties and/or flexibility of a plurality of grooves can be fine tuned by varying the number of grooves. In other embodiments, the arrangement of grooves can be varied to fine tune the gripping properties and/or flexibility of the plurality of grooves. For example, by using different groove depths, the gripping properties and/or flexibility can be varied. Also, by arranging grooves of varying depths in different arrangements, the gripping properties and/or flexibility of the thong portion can be fine tuned.

Figure 4:
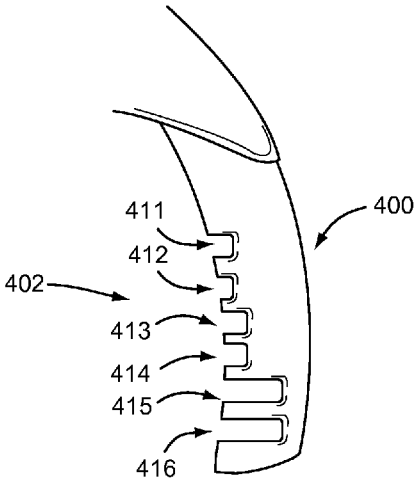
FIG. 4 is an enlarged view of an embodiment of a thong portion of an article of footwear with a stepped groove configuration.

Referring to FIG. 4, thong portion 400 may comprise plurality of grooves 402. In some cases, plurality of grooves 402 can be arranged in a step-like configuration. In other words, the depths of two or more grooves may vary in a step-like manner. In this embodiment, first groove 411 and second groove 412 have a substantially similar depth. Also, third groove 413 and fourth groove 414 have a substantially similar depth. Furthermore, fifth groove 415 and sixth groove 416 have a substantially similar depth. In addition, the depths of third groove 413 and fourth groove 414 are substantially greater than the depths of first groove 411 and second groove 412. Likewise, the depths of fifth groove 415 and sixth groove 416 are substantially greater than the depths of third groove 413 and fourth groove 414. By using this stepped arrangement for the groove depths, the grip provided by thong portion 400 can vary substantially over the length of thong portion 400. Also, the stepped arrangement may help facilitate differential flexibility over the length of thong portion 400.

Figure 5:
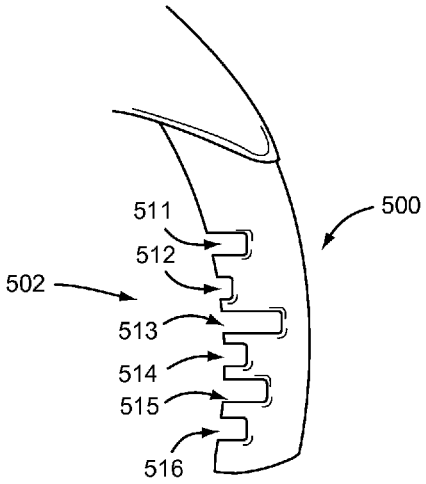
FIG. 5 is an enlarged view of an embodiment of a thong portion of an article of footwear with an irregular groove configuration.

Referring to FIG. 5, thong portion 500 may comprise plurality of grooves 502. In some cases, plurality of grooves 502 may have an irregular configuration. In particular, the depths of first groove 511, second groove 512, third groove 513, fourth groove 514, fifth groove 515 and sixth groove 516 can vary in an irregular manner. By using this irregular arrangement for the groove depths, the grip and/or flex provided by thong portion 500 can be varied in an irregular manner over the length of thong portion 500.

Figure 6:
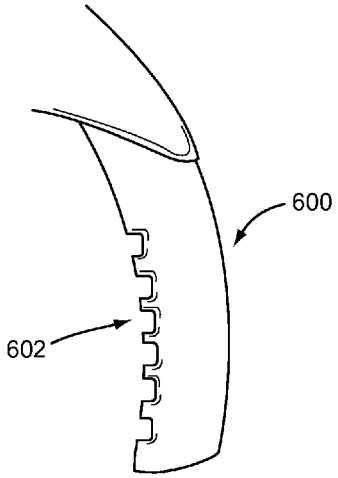
FIG. 6 is an enlarged view of an embodiment of a thong portion of an article of footwear with a shallow groove configuration.

Referring to FIG. 6, thong portion 600 may comprise plurality of grooves 602. In some cases, plurality of grooves 602 may be substantially shallow grooves. For example, in one embodiment, the depth of each groove of plurality of grooves 602 may have a value approximately in the range between 1 percent and 20 percent of the diameter of thong portion 600. In some cases, providing substantially shallow grooves on thong portion 600 may provide only a small amount of gripping and/or flexibility for thong portion 600.

Figure 7:
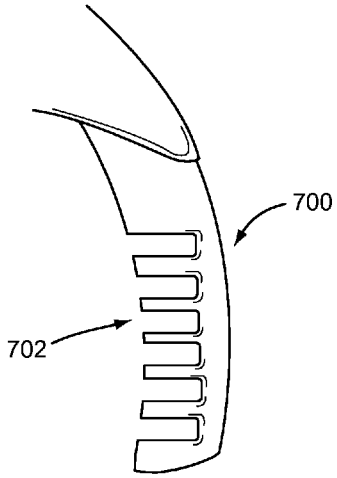
FIG. 7 is an enlarged view of an embodiment of a thong portion of an article of footwear with a deep groove configuration.

Referring to FIG. 7, thong portion 700 may comprise plurality of grooves 702. In some cases, plurality of grooves 702 may be substantially deep grooves. For example, in one embodiment, the depth of each groove of plurality of grooves 702 may have a value approximately in the range between 80 percent and 99 percent of the diameter of thong portion 700. In some cases, providing substantially deep grooves on thong portion 700 may provide a high amount of gripping and/or flexibility for thong portion 700.

Figure 8:
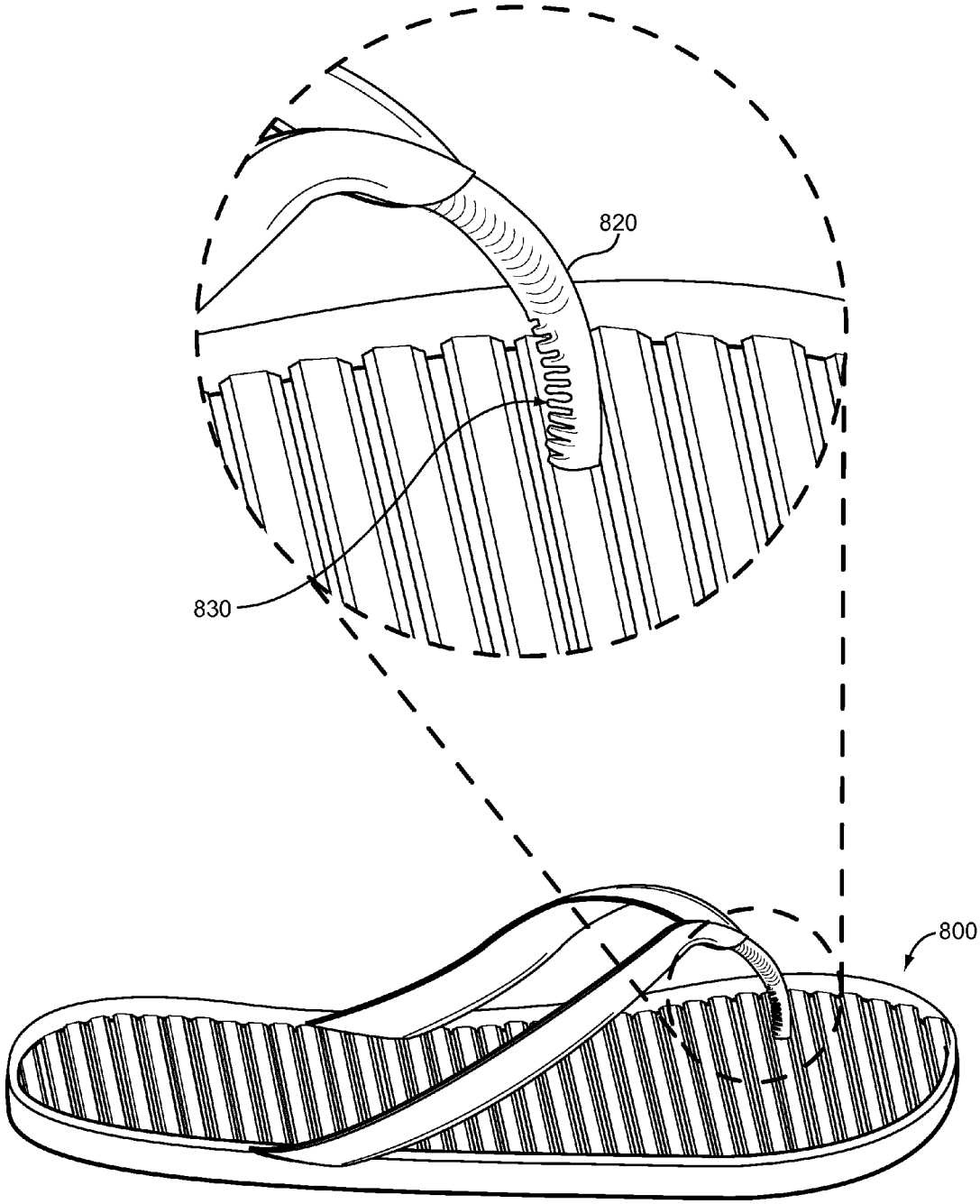
FIG. 8 is an isometric view of an embodiment of an article of footwear.

FIG. 8 illustrates another embodiment of article of footwear 800. In this embodiment, article 800 includes thong portion 820. In some cases, thong portion 820 can be provided with plurality of grooves 830. In one embodiment, plurality of grooves 830 may comprise approximately 10 grooves. In other embodiments, however, the number of grooves comprising plurality of grooves 830 can vary.

Plurality of grooves 830 can be provided with a relatively small or narrow pitch. The term pitch refers to a dimension of a groove as measured along an axial direction of thong portion 820. In some cases, the pitch of each groove can vary in the range between 0.001 millimeters and 10 millimeters. In other cases, the pitch of each groove can vary in the range between 0.01 millimeters and 1 millimeter. In still other cases, the pitch of each groove could be greater than 10 millimeters.

Although the current embodiment includes grooves with a relatively constant pitch, in other embodiments the pitch of each groove could vary. For example, in one embodiment, a thong portion could comprise a plurality of grooves including some grooves with a first pitch and some grooves with a second pitch that is greater than the first pitch. In still other embodiments, the pitch of each groove could vary in any other manner. By varying the pitch of each groove, the flexibility and/or gripping characteristics of a thong portion can be fine tuned.

In some embodiments, the spacing between adjacent grooves can also vary. In some cases, the spacing between adjacent grooves can vary in the range between 0.001 millimeters and 10 millimeters. In other cases, the spacing between adjacent grooves can vary in the range between 0.01 millimeters and 1 millimeter. In still other cases, the spacing between adjacent grooves can be greater than 10 millimeters.

Although the current embodiment includes grooves that are evenly spaced, in other embodiments, the spacing between adjacent grooves could vary. For example, in one embodiment, a thong portion could comprise a plurality of grooves with one pair of adjacent grooves that are spaced by a first spacing and a second pair of adjacent grooves that are spaced apart by a second spacing that is greater than the first spacing. In still other embodiments, the spacing between adjacent grooves could vary in any other manner.

It will also be understood that in some other embodiments, both the pitches of grooves and the spacing between grooves can be varied to accomplish various configurations for a plurality of grooves. By varying both the pitches of grooves as well as the spacing between grooves, the flexibility and/or gripping characteristics of a thong portion can be fine tuned.

An article can include provisions for enhancing grip between a thong portion and different portions of one or more toes. In different embodiments, the shape of a groove can be varied to extend over different regions of a thong portion for enhancing grip with sides of the toes as well as with the region between adjacent toes. For example, in some cases, regions of a thong portion that may be disposed against the sides of a big toe and an index toe may include grooves. In other cases, regions of a thong portion that may be disposed against the webbing between a big toe and an index toe may include grooves.

Figure 9:
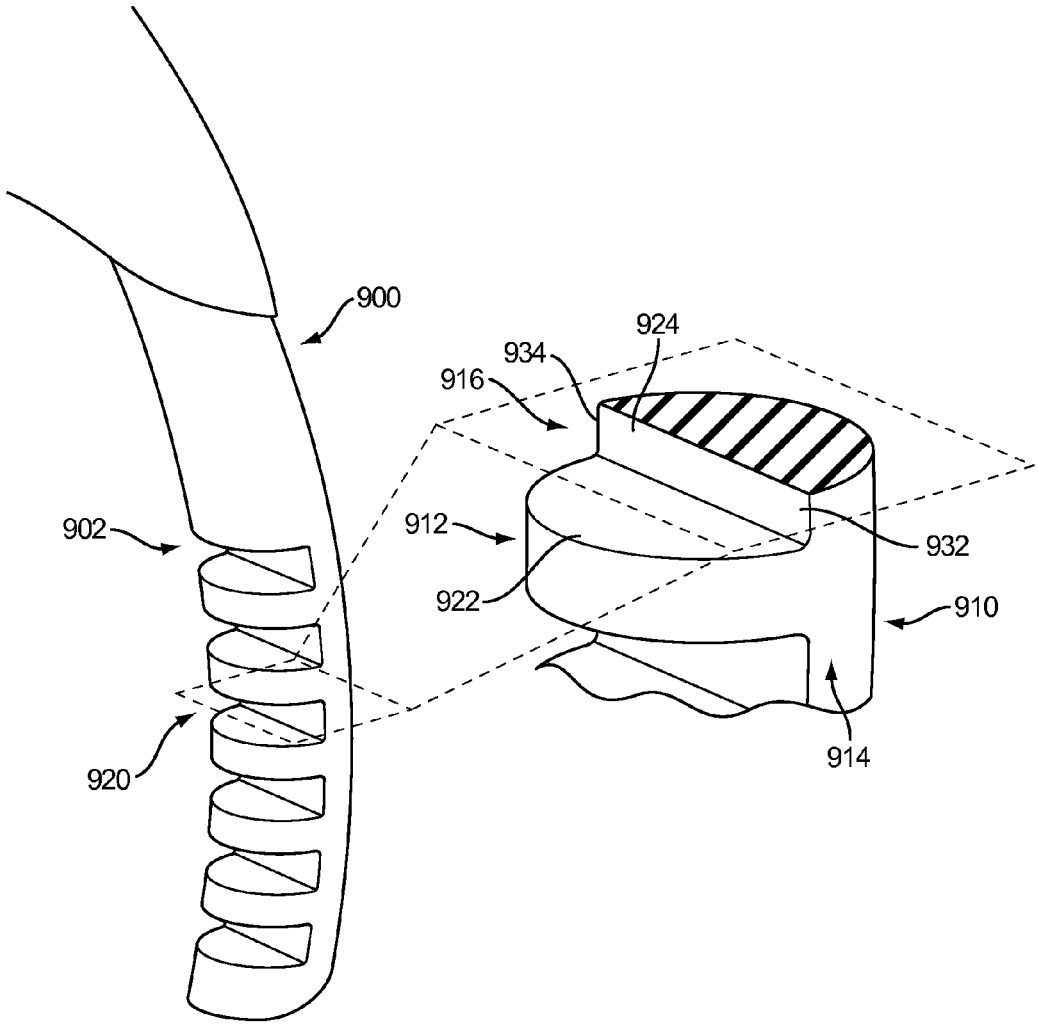
FIG. 9 is an isometric view of a thong portion with grooves having semi-circular shapes.

FIG. 9 illustrates an isometric view of an embodiment of thong portion 900. Thong portion 900 can include forward portion 910 that is oriented towards a front of an article and rearward portion 912 that is oriented towards a rear of an article. Thong portion 900 can also include first side portion 914 and second side portion 916, which extend between forward portion 910 and rearward portion 912. Thong portion 900 can further include plurality of grooves 902. In the current embodiment, thong portion 900 includes six grooves. However, in other embodiments, thong portion 900 can include any other number of grooves.

In some embodiments, plurality of grooves 902 can be provided with a substantially semi-circular shape. For example, in this embodiment, groove 920 has a substantially semi-circular shape. In particular, groove 920 is bounded between lower groove surface 922, an upper groove surface (not shown) disposed opposite of lower surface 922 and rear groove surface 924. Lower groove surface 922 and the upper groove surface may have substantially similar semi-circular shapes. In addition, rear groove surface 924 has a substantially rectangular shape. In this case, rear groove surface 924 is a substantially straight rear groove surface.

With this arrangement, groove 920 may extend from rearward portion 912 of thong portion 900 to first side portion 914 and second side portion 916. In some cases, first lateral end 932 of groove 920 may be disposed midway between forward portion 910 and rearward portion 914 of thong portion 900. Likewise, second lateral end 934 of groove 920 may be disposed midway between forward portion 910 and rearward portion 912. In a similar manner, each of the remaining grooves of plurality of grooves 902 may have substantially similar shapes to groove 920. In particular, each groove may have a substantially similar semi-circular shape to groove 920. Using this configuration, plurality of grooves 902 may be configured to enhance grip between a webbing of two adjacent toes and thong portion 900, since plurality of grooves 902 are disposed on rearward portion 912 of thong portion 900.

Figure 10:
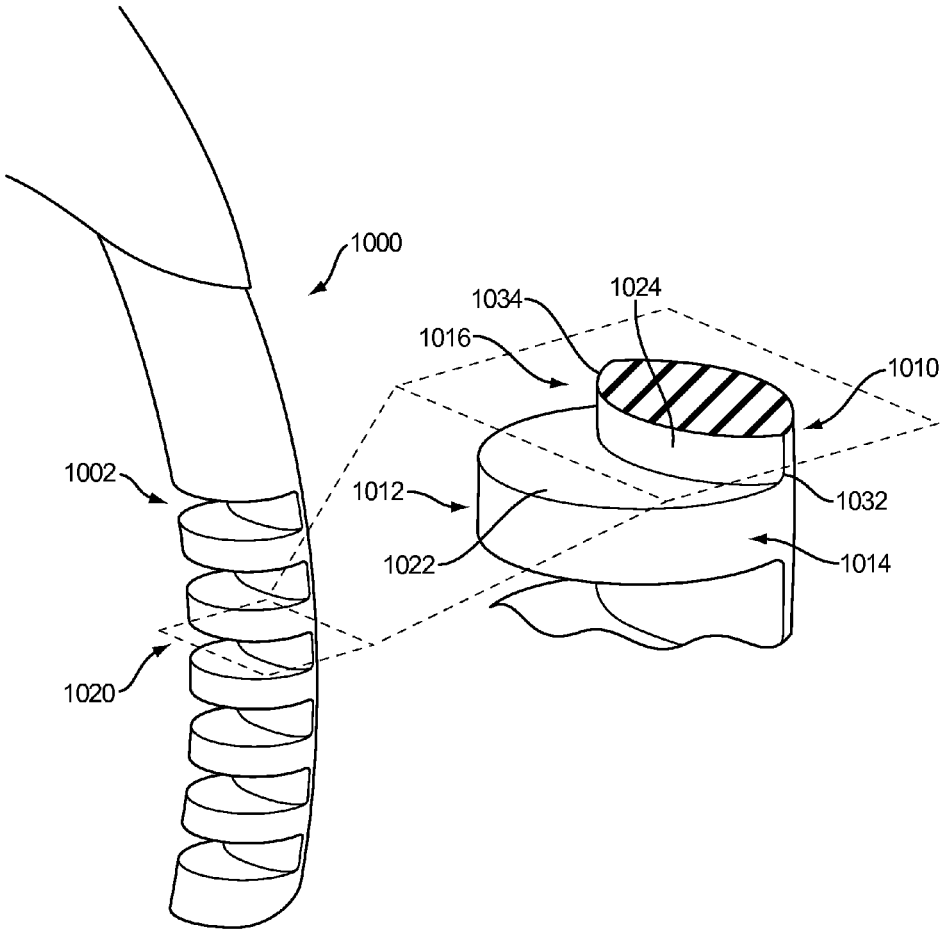
FIG. 10 is an isometric view of a thong portion with grooves having crescent-like shapes.

FIG. 10 illustrates an isometric view of an embodiment of thong portion 1000. Thong portion 1000 can include forward portion 1010 that is oriented towards a front of an article and rearward portion 1012 that is oriented towards a rear of an article. Thong portion 1000 can also include first side portion 1014 and second side portion 1016, which extend between forward portion 1010 and rearward portion 1012. Thong portion 1000 can further include plurality of grooves 1002. In the current embodiment, thong portion 1000 includes six grooves. However, in other embodiments, thong portion 1000 can include any other number of grooves.

In some embodiments, plurality of grooves 1002 can be provided with a crescent-like shape. For example, in this embodiment, groove 1020 has a substantially crescent-like shape. In particular, groove 1020 is bounded between lower groove surface 1022, an upper groove surface (not shown) disposed opposite of lower surface 1022 and rear groove surface 1024. Lower groove surface 1022 and the upper groove surface may have substantially similar crescent-like shapes. In addition, rear groove surface 1024 has a substantially curved shape.

With this arrangement, groove 1020 may extend from rearward portion 1012 of thong portion 1000 to front portion 1010 in a crescent-like configuration. In some cases, first lateral end 1032 of groove 1020 may be disposed within forward portion 1010. Likewise, second lateral end 1034 of groove 1020 may be disposed within forward portion 1010. In a similar manner, each of the remaining grooves of plurality of grooves 1002 may have substantially similar shapes to groove 1020. In particular, each groove may have a substantially similar crescent-like shape to groove 1020. Using this configuration, plurality of grooves 1002 may be configured to enhance grip between a webbing of two adjacent toes and thong portion 1000. Additionally, as plurality of grooves 1002 extend through a majority of both first side portion 1014 and second side portion 1016, plurality of grooves 1020 may provide enhanced grip between thong portion 1000 and side of toes that may be disposed against first side portion 1014 and second side portion 1016. This arrangement can help to increase grip between a thong portion and toes adjacent to the thong portion since the grooves extend throughout the contact region between the toes and the thong portion.

In another embodiment, grooves could be disposed primarily on side portions of a thong portion. In some cases, grooves could be disposed on a first side portion of a thong portion. In other cases, grooves could be disposed on a second side portion of a thong portion, where the second side portion is disposed opposite of a first side portion. In an exemplary embodiment, grooves could be disposed on a first side portion and a second side portion.

Figure 11:
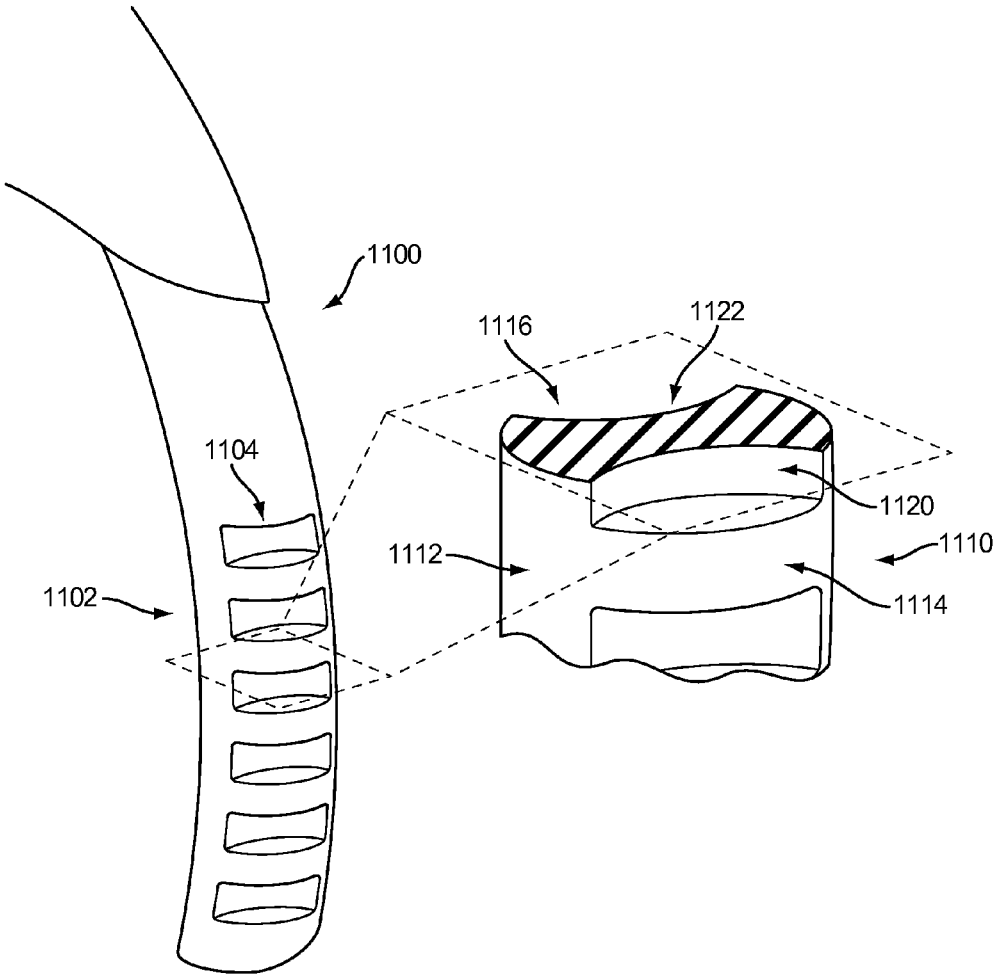
FIG. 11 is an isometric view of a thong portion with grooves disposed on side portions of the thong portion.
Figure 12:
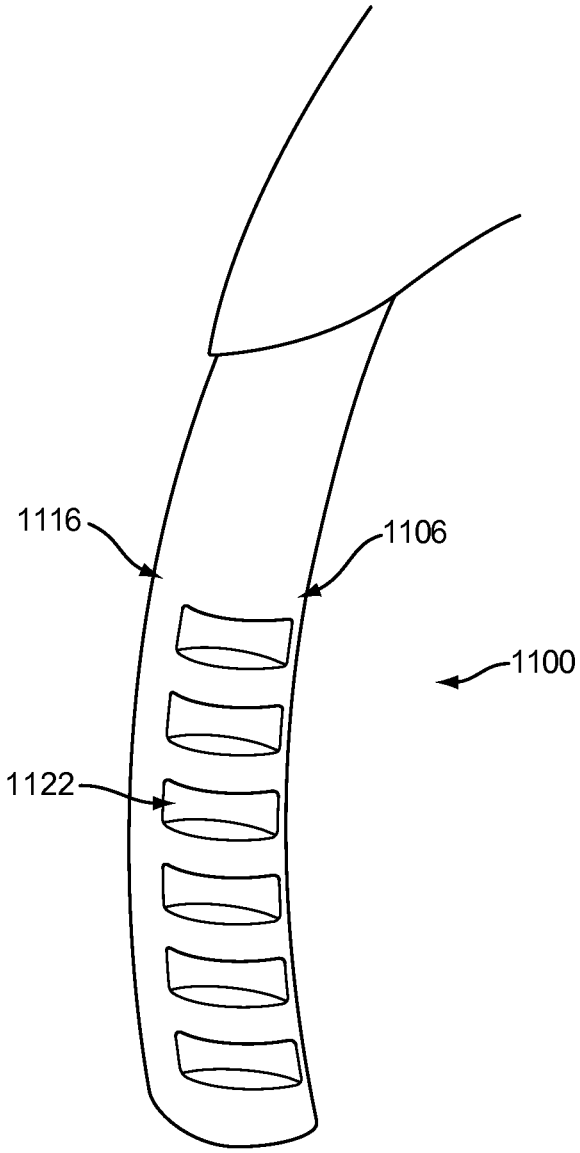
FIG. 12 is an isometric view of a thong portion with grooves disposed on side portions of the thong portion.

FIGS. 11-12 illustrate isometric views of an embodiment of thong portion 1100. Thong portion 1100 can include forward portion 1110 that is oriented towards a front of an article and rearward portion 1112 that is oriented towards a rear of an article. Thong portion 1100 can also include first side portion 1114 and second side portion 1116, which extend between forward portion 1110 and rearward portion 1112.

Thong portion 1100 can further include plurality of grooves 1102. In some cases, plurality of grooves 1102 can include first groove set 1104 and a second groove set 1106. First groove set 1104 can comprise six grooves disposed on first side portion 1114 of thong portion 1100. In addition, second groove set 1106 may comprise six grooves disposed on second side portion 1116. In some cases, grooves of first groove set 1104 may be approximately aligned with grooves of the second groove set. For example, in the current embodiment, first groove 1120 of first groove set 1104 can be aligned with second groove 1122 of second groove set 1106.

Using this arrangement, plurality of grooves 1102 may be configured enhance grip between the sides of adjacent toes and thong portion 1100. For example, in one embodiment, grooves of first groove set 1104 can be configured to enhance grip between the side of a big toe and thong portion 1100. In addition, grooves of second groove set 1106 can be configured to enhance grip between the side of an index toe and thong portion 1100.

Figure 13:
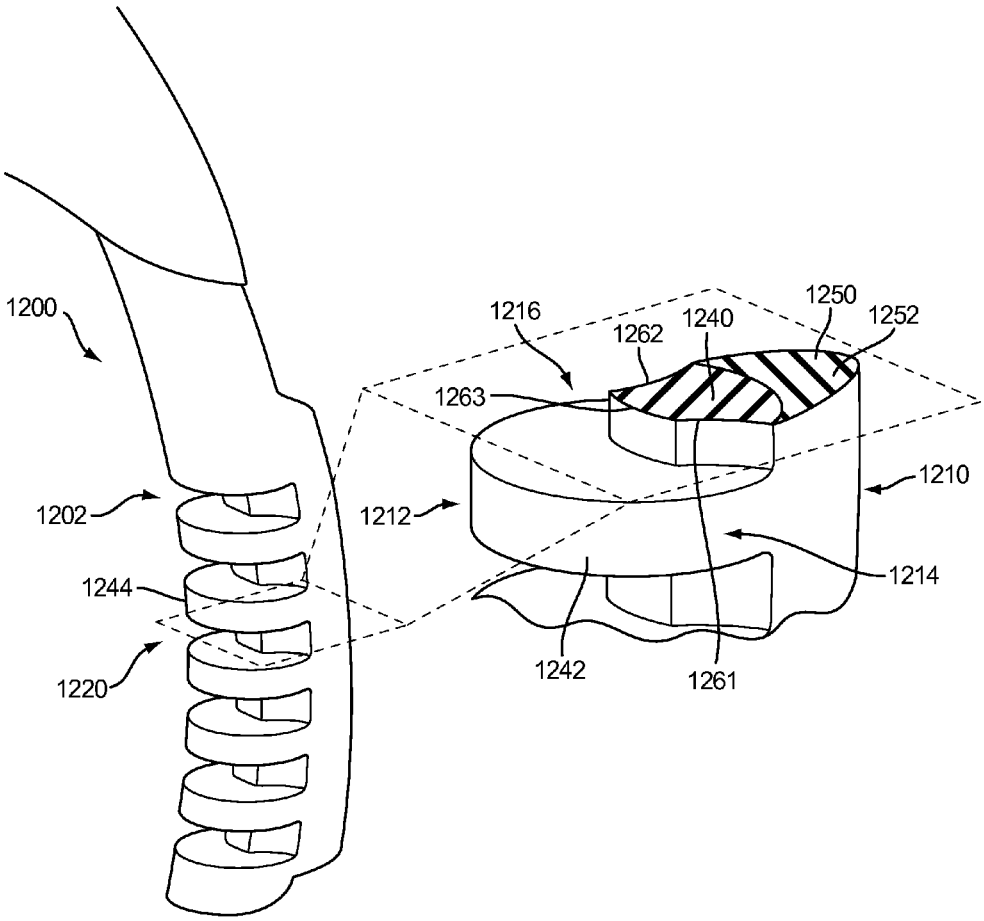
FIG. 13 is an isometric view of a thong portion including a reinforcing portion.

In another embodiment, grooves could extend through a substantial majority of a thong portion to maximize grip between adjacent toes and the thong portion. FIG. 13 illustrates an embodiment of thong portion 1200. Thong portion 1200 can include forward portion 1210 that is oriented towards a front of an article and rearward portion 1212 that is oriented towards a rear of an article. Thong portion 1200 can also include first side portion 1214 and second side portion 1216, which extend between forward portion 1210 and rearward portion 1212. Thong portion 1200 can further include plurality of grooves 1202. In the current embodiment, thong portion 1200 includes six grooves. However, in other embodiments, thong portion 1200 can include any other number of grooves.

Plurality of grooves 1202 can comprise first groove 1220. In some embodiments, first groove 1220 can be configured with a substantially large cross-sectional area. In some cases, first groove 1220 may extend through rearward portion 1212, first side portion 1214 and second side portion 1216. In addition, first groove 1220 may extend into forward portion 1210. In an exemplary embodiment, first groove 1220 may extend through a substantially majority of the cross-sectional area of thong portion 1200.

In one embodiment, thong portion 1200 can comprise a plurality of connecting portions that extend between adjacent portions of thong portion 1200 that are separated by grooves. For example, thong portion 1200 can include connecting portion 1240 that extends between first portion 1242 and second portion 1244 of thong portion 1200. In this case, first portion 1242 and second portion 1244 may have substantially circular or oval-like cross-sectional areas. In contrast, connecting portion 1240 may have a polygonal-like cross-sectional shape including distinct edges. In this case, connecting portion 1240 may include first edge 1261, second edge 1262 and third edge 1263. First edge 1261, second edge 1262 and third edge 1263 can have any shapes including, but not limited to straight shapes, convex shapes, concave shapes as well as any other shapes. In an exemplary embodiment, first edge 1261 and second edge 1262 may have substantially concave edges, while third edge 1263 may have an approximately straight edge. Similarly, thong portion 1200 can include a plurality of connecting portions associated with each groove of plurality of grooves 1202.

In some embodiments, thong portion 1200 can include provisions for reinforcing regions of a thong where grooves are located. In some embodiments, thong portion 1200 can be provided with one or more reinforcing portions. In an exemplary embodiment, thong portion 1200 can be provided with reinforcing portion 1250 that extends along the length of thong portion 1200 adjacent to plurality of grooves 1202. This arrangement may provide an increased cross-sectional area for thong portion 1200 in the regions associated grooves, to help increase the rigidity of thong portion 1200 in these regions. For example, in the current embodiment, first portion 1252 of reinforcing portion 1250 may provided an extended cross-sectional area for connecting portion 1240 in order to enhance the strength of thong portion 1200 at first groove 1220.

In different embodiments, the shape of a reinforcing portion could vary. In one embodiment, a reinforcing portion could have a rib-like shape. In an exemplary embodiment, a reinforcing portion could have a fin-like shape. Additionally, in some embodiments, a reinforcing portion could have a substantially constant cross-sectional area. In other embodiments, the cross-sectional area of a reinforcing portion could vary. For example, in one embodiment, a reinforcing portion may have a larger cross-sectional area on regions of a thong portion associated with grooves. In addition, while the current embodiment illustrates a single reinforcing portion that extends across a majority of a thong portion, in other embodiments multiple reinforcing portions could be used.

In different embodiments, the material properties of a reinforcing portion could vary. In some cases, a reinforcing portion could be more rigid than a thong portion. In other cases, a reinforcing portion could be less rigid than a thong portion. In one embodiment, reinforcing portion 1250 may be made of a first material that is substantially different from a second material used to make thong portion 1250. In some cases, the first material could be substantially more rigid than the second material. This arrangement may help reinforcing portion 1250 to reinforce thong portion 1200 in regions adjacent to plurality of grooves 1202.

Articles of the embodiments discussed above may be made from materials known in the art for making articles of footwear. For example, a sole structure may be made from any suitable material, including, but not limited to: elastomers, siloxanes, natural rubber, other synthetic rubbers, aluminum, steel, natural leather, synthetic leather, foams or plastics. In addition, a thong portion used with an article of footwear can be may from any suitable material, including, but not limited to: elastomers, siloxanes, natural rubber, other synthetic rubbers, leathers, foams or plastics. In one embodiment, a thong portion may be made from an elastomer material.

It will be understood that grooves can be provided in a thong portion of an article of footwear in any manner. In some cases, grooves can be formed during a molding process for forming the thong portion. In other cases, grooves can be formed in a thong portion using cutting or similar techniques. In still other cases, grooves can be formed in any other manner.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear, comprising:

a sole;

a thong portion including a first end portion, a second end portion and an intermediate portion disposed between the first end portion and the second end portion;

the first end portion associated with a first portion of the sole;

the second end portion associated with a strap, the strap being configured to wrap around a portion of a foot;

the thong portion including a substantially symmetric core having a forward portion that is oriented towards a front of the article of footwear and a rearward portion that is oriented towards a rear of the article of footwear; and the substantially symmetric core having an outer surface; and the substantially symmetric core including a groove set disposed in the rearward portion extending inward from the outer surface of the substantially symmetric core through a substantial majority of the cross-sectional area of the substantially symmetric core; and a reinforcing portion extending forward from the outer surface of the forward portion of the substantially symmetric core, and extending along a length of the groove set.

2. The article of footwear of claim 1, wherein the reinforcing portion has a length that is less than a length of the thong portion.

3. The article of footwear according to claim 1, wherein the reinforcing portion has a rib-like shape or a fin-like shape.

4. The article of footwear according to claim 1, wherein the outer surface of the substantially symmetric core has a substantially consistent cross-sectional size and shape, except for grooves of the groove set, over the length of the groove set.

5. The article of footwear according to claim 1, wherein the thong portion includes a plurality of connecting portions that extend between adjacent portions of the thong portion that are separated by grooves of the groove set.

6. The article of footwear according to claim 5, wherein the at least one of the connecting portions has a polygonal-like cross-sectional shape.

7. The article of footwear of claim 5, wherein the polygonal-like cross-sectional shape includes at least one concave edge or at least one convex edge.

8. The article of footwear of claim 5, wherein the connecting portions are formed of a different material than the reinforcing portion.

9. An article of footwear, comprising:

a sole;

a thong portion including a first end portion, a second end portion and an intermediate portion disposed between the first end portion and the second end portion;

the first end portion associated with a first portion of the sole;

the second end portion associated with a strap, the strap being configured to wrap around a portion of a foot;

the thong portion including a forward portion that is oriented towards a front of the article of footwear and a rearward portion that is oriented towards a rear of the article of footwear;

the thong portion having an outer surface; and the thong portion including a groove set in the rearward portion extending inward from the outer surface of the thong portion through at least a portion of the cross-sectional area of the thong portion; and a reinforcing portion extending forward from the outer surface of the forward portion of the thong portion, and extending along a length of the groove set;

wherein the reinforcing portion has a length that is less than a length of the thong portion.

10. The article of footwear according to claim 9, wherein the reinforcing portion has a rib-like shape or a fin-like shape.

11. The article of footwear according to claim 9, wherein the outer surface of the thong portion has a substantially consistent cross-sectional size and shape, except for grooves of the groove set, over the length of the groove set.

12. The article of footwear according to claim 9, wherein the thong portion includes a plurality of connecting portions that extend between adjacent portions of the thong portion that are separated by grooves of the groove set.

13. The article of footwear according to claim 12, wherein the at least one of the connecting portions has a polygonal-like cross-sectional shape.

14. The article of footwear of claim 13, wherein the polygonal-like cross-sectional shape includes at least one concave edge.

15. The article of footwear of claim 13, wherein the polygonal-like cross-sectional shape includes at least one convex edge.

16. The article of footwear of claim 12, wherein the connecting portions are formed of a different material than the reinforcing portion.

17. An article of footwear, comprising:

a sole;

a thong portion including a first end portion, a second end portion and an intermediate portion disposed between the first end portion and the second end portion;

the first end portion associated with a first portion of the sole;

the second end portion associated with a strap, the strap being configured to wrap around a portion of a foot;

the thong portion including a substantially symmetric core having a forward portion that is oriented towards a front of the article of footwear and a rearward portion that is oriented towards a rear of the article of footwear;

the substantially symmetric core having an outer surface; and the substantially symmetric core including a groove set in the rearward portion extending inward from the outer surface of the substantially symmetric core through a substantial majority of the cross-sectional area of the substantially symmetric core; and a reinforcing portion extending forward from the forward portion of the substantially symmetric core;

the forward portion of the thong portion including a first front surface defined by the reinforcing portion and a second front surface defined by the substantially symmetric core above the reinforcing portion;

the first front surface being located further forward than the second front surface.

18. The article of footwear according to claim 17, wherein the reinforcing portion has a rib-like shape or a fin-like shape.

19. The article of footwear according to claim 17, wherein the thong portion includes a plurality of connecting portions that extend between adjacent portions of the thong portion that are separated by grooves of the groove set.

20. The article of footwear of claim 19, wherein the polygonal-like cross-sectional shape includes at least one concave edge or at least one convex edge.

* * * * *